US005344145A

United States Patent [19]

Chadwick et al.

[11] Patent Number: 5,344,145

[45] Date of Patent: Sep. 6, 1994

[54] GAMING OR AMUSEMENT MACHINES

[75] Inventors: Neville D. Chadwick; Terence Howard, both of Nottingham, England

[73] Assignee: Bell-Fruit Manufacturing Company Limited, Nottingham, England

[21] Appl. No.: 994,274

[22] Filed: Dec. 21, 1992

[30] Foreign Application Priority Data

Jul. 1, 1992 [GB] United Kingdom ..... 9213945

[51] Int. Cl.[5] ..... A63F 9/24

[52] U.S. Cl. ..... 273/138 A; 273/145 R

[58] Field of Search ..... 273/138 A, 138 R, 145 R, 273/287, 146

[56] References Cited

U.S. PATENT DOCUMENTS 4,181,304 1/1980 Haber ..... 273/146
4,552,362 11/1985 Oake ..... 273/237
4,844,467 7/1989 Gyenge ..... 273/161

FOREIGN PATENT DOCUMENTS 2400679A 8/1974 Fed. Rep. of Germany ... 273/142 B
4035757A 8/1990 Fed. Rep. of Germany ... 273/138 A
2147510A 6/1984 United Kingdom ..... 273/138 A

*Primary Examiner*—Benjamin H. Layno
*Attorney, Agent, or Firm*—Christensen, O'Connor, Johnson & Kindness

[57] ABSTRACT

A gaming or amusement machine has a dice or other multi-faceted symbol-carrying body which is in the region of a viewing station of the machine. The body is movable by drive means under the control of control means to present a known selected facet to the viewing station for viewing. One embodiment uses only a single motor and single sensor even though the body is movable about two different axes.

15 Claims, 2 Drawing Sheets

GAMING OR AMUSEMENT MACHINES

FIELD OF THE INVENTION

This invention relates to gaming or amusement machines.

BACKGROUND OF THE INVENTION

It is well known to display symbols, such as representations of fruits, playing cards and so on, within amusement machines using mechanically-rotating reel mechanisms with the symbols arranged around the periphery of a rotating drum assembly, as in the so-called "fruit machine". It is also known to display as part of such machines other symbols, in particular dice, which have associations with other forms of gaming, in order to represent such other games within the framework of a fruit machine game.

However, there is a considerable difference between the appearance of a three-dimensional die and its representations on a two-dimensional surface of a reel strip, and such representations are not as popular with the players of such games as perhaps they would be were the representation more realistic.

We have already proposed improvements in the symbols used in fruit machines, for example in our patent application GB 8918448.5 in which the symbols have a three dimensional profile. A representation of a die can be made three dimensional in this way, but it only has one face visible to the user.

SUMMARY OF THE INVENTION

According to the invention a gaming or amusement machine in which symbols are presented at a viewing station comprises a die or other multi-faceted symbol-carrying body, sensor means adapted to detect the orientation of the die with respect to a viewing station and adapted to produce signals indicative of the facet or symbol presented to the viewing station by the die, drive means adapted to move the die between different presentation positions in which different facets of the die are presented to the viewing station, and control means which receives signals from the sensor means and controls the drive means so that the facet or symbol presented to the viewing station is known to the control means and controlled by it.

This enables us to use dice in a fruit machine.

It is true that dice-throwing devices per-se are known in which a die is contained within a transparent box and is impelled into the air by the action of a sharp blow or impact upon its base, usually derived from a solenoid. Detecting means within the box can determine which face of the die is uppermost. This idea can be extended to a collection of several dice to form a complete game in its own right. The "throwing" of the die is to all intents and purposes a random event. Often within a gaming or amusement machine it is desired to pre-determine the outcome of a game, or at least to influence it so that it is pseudo-random in a controllable manner. This is not possible with known dice-throwing machines and so they are not suitable for use in fruit machines and are not considered to be of any importance in the field of fruit machines.

It is also known from GB 2 147 510 to have a die which rotates about an axis Joining two of its diametrally opposed corners, and to illuminate an upper or lower face of a pair of faces presented to a viewing station so that the user can identify which of the pair of faces is selected to be in play.

Preferably the die or body of the present invention is movable about two axes.

Preferably the die or body is movable about the two axes by a single motor or drive means. Most preferably the two axes are substantially perpendicular.

Preferably the drive means includes an input motive means which causes movement about the two axes. The input motive means is preferably a shaft which rotates. The shaft may be parallel with, or co-axial with, one of the axes, and a die-carrying member may be moved around the one axis, with coupling means transferring motive force to a second axis drive mechanism mounted on the die-carrying member. The coupling means may comprise an epicyclic or sun and planet gear system. There may be an intermediate gear between the sun and planet gear.

A die may rotate about the first and second axes at a fixed ratio, which is preferably an integral number. The ratio is most preferably related to the number of faces that are provided on the die or other body, preferably in such a way that all of the faces of the die which can be presented to the viewing station are presented in turn in a predetermined sequence. The ratio may be $1:\frac{1}{2}(n)$, where n is the number of faces of the die.

There is preferably only a single position sensor provided to sense the position or orientation of the die.

Preferably the die or body is angularly movable about a first axis so as to present in turn a number of its facets to the viewing station. It is preferably movable to a changed axis-orientation state in which the orientation of the first axis relative to the viewing station is changed so that subsequent angular movement of the die about the first axis presents one or more different facets to the viewing station which cannot be seen readily with the first axis in its original orientation.

Preferably a chosen facet of the die or body is presented to said viewing station so that the plane of the chosen facet is substantially perpendicular to a line of sight from a user of said machine.

The movement of the first axis from its first orientation relative to the viewing station to its changed orientation may comprise an angular movement of the first axis relative to the viewing station.

The first axis may pass through opposed vertices of the die or body.

The movement of the first axis to the changed axis-orientation state may comprise rotation of the first axis through at least substantially 90 degrees about a second axis substantially perpendicular to the first axis. Such a movement may comprise angular movement of substantially 90 degrees.

Preferably the die or body may be carried by yoke means. Most preferably the yoke means is rotatable about the second axis.

The die or body may be internally illuminated.

According to a second aspect of the invention we provide a die or other multi-faceted symbol-presenting body mechanism adapted for incorporation in a gaming or amusement machine, the mechanism comprising the body, sensor means adapted to detect the orientation of the body and adapted to produce signals indicative of the orientation of the body, drive means adapted to move the body between different presentation positions in which the body has different orientations, and control means which receives signals from the sensor means and controls the drive means so that the facet or symbol presented by the body to a viewing station is known to the control means and controlled by it.

BRIEF DESCRIPTION OF THE DRAWINGS

An embodiment of the invention will now be described by way of example only with reference to the accompanying drawings of which.

DETAILED DESCRIPTION OF THE PREFERRED EMBODIMENTS

Figure 1:
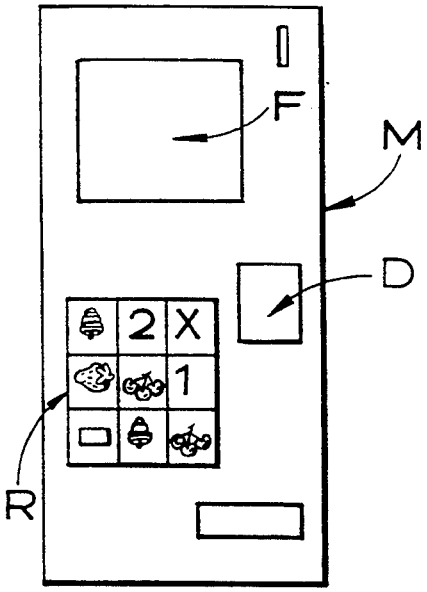
FIG. 1 shows a fruit machine incorporating the invention.

A fruit machine M has a coin input slot, a payout tray, a reel display R comprising three reels, a feature display F indicating game features such as "trail" features and/or "skill-shot" features (terms known in the art and discussed in some of our earlier patent applications), and a die display, or viewing station, D.

The die display D comprises a cube 1 representing the die rotationally mounted at two diagonally opposed vertices by a rod 2 held by bearings 14 and 15 in a frame arrangement 3 supported by suitable idler pulleys 4 and a drive pulley 5. Drive means are provided for the rod 2 by a motor 6, and for the pulley 5 by a motor 7. The cube 1 can be rotated through 360 degrees by the motor 6 and rod 2, and the frame 3 can be rotated by at least 90 degrees by the motor 7 and pulley 5. Photoelectric sensors 8 and 9 pick up position-identifying information from suitable sensor components 10 and 11 affixed to the cube drive rod 2 and frame 3 respectively, so that the absolute position of the cube 1 can be determined by control means 12, which also controls the motors 6 and 7. Appropriate drive signals are generated by the control means 12 and fed to motors 6 and 7 and in conjunction with the positional feedback information from sensor components 10 and 11 the control means 12 can arrange for any of the six faces of the cube to be presented to the player of the machine at the viewing station, the player viewing the cube from a viewing position along the line 13. In use the cube would rest in any of six "index" positions, in which one of its faces is presented perpendicularly to the player along viewing line 13. Motion may be imparted to the die in order to alter the displayed face during a game by use of the motors 6 and 7.

Figure 2:
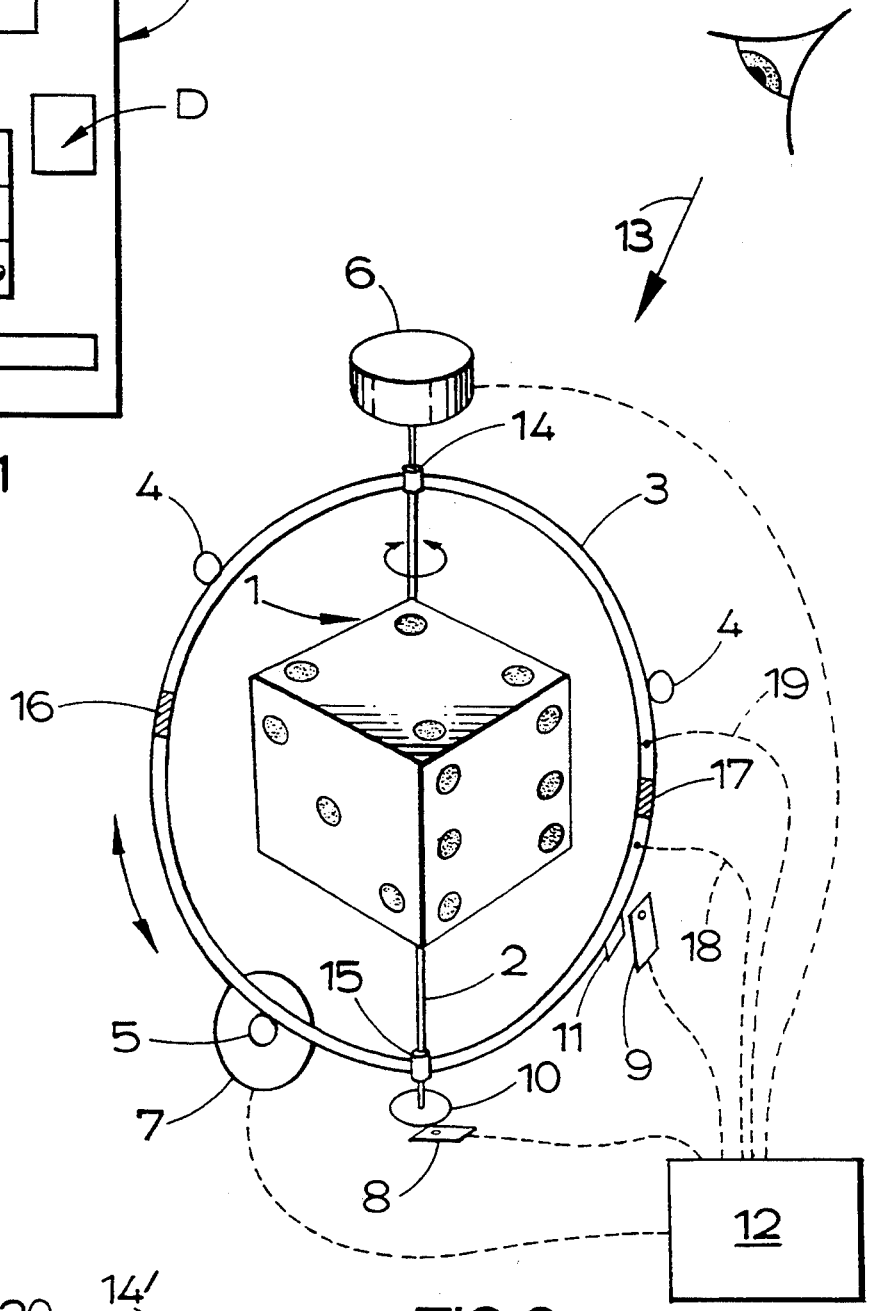
FIG. 2 illustrates the die mechanism of the fruit machine of FIG. 1 in schematic detail.

The cube may be illuminated from within, power for this purpose being advantageously passed down opposing projecting sides of the cube supporting rods 2, this being split inside the cube into two parts made of a suitable conducting medium. The electrical connections then being made by means of wires attached to the supporting bearings 14 and 15 on the outer frame, and the outer frame 3 being suitably insulated at least two parts of its circumference. Alternatively, electrical connections 18 and 19 could be made to suitable points on the frame 3 as shown in FIG. 2, again with insulating parts 16 and 17 of the frame being provided. The motor 6 moves around with the frame 3, or a coupling capable of accommodating the motion is provided.

Various alternative embodiments are possible within the framework of this invention. For instance, the symbols depicted do not necessarily need to represent a die and could be any other desired symbols such as fruits, playing cards or indeed just blocks of different colour. The surface of such symbols could be formed in relief in a manner outlined in our British patent application GB 89184448.5.

The supported body which in the example is cubic could be any desired geometrical polygon with an appropriate adjustment being made to the control means to provide the requisite index positions in order to be able to present each symbol to the player's view. The body could have curved surfaces and could even be a sphere.

The positional feedback could be by optical, magnetic or other suitable means. The rotational drive for the supported body could be by means of an integral electric motor of the stepper (or other) kind supported on the outer frame and directly driving the rod as described, or by means of a friction drive onto an extension of the support rod.

Figure 3:
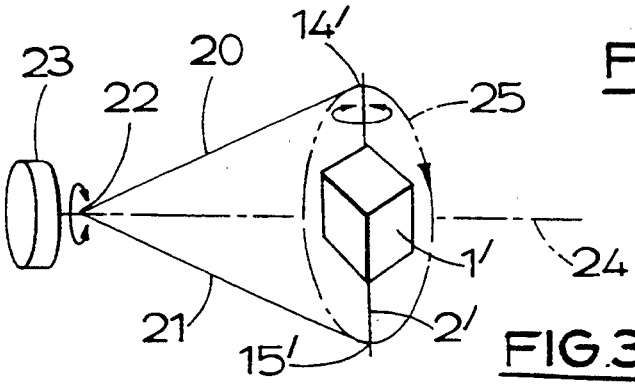
FIG. 3 shows an alternative die mechanism.

An alternative support frame for the dice is shown in FIG. 3 and comprises a skeletal frame of two wires 20 and 21 (of suitable strength) as shown in FIG. 3, attached to bearing points 14' and 15' of rod 2', and formed so that they come together at a suitable drive point 22 such that an equivalent rotation in the same plane as that described for frame 3 would be achieved by means of a direct drive motor 23 instead of an intermediate pulley. The wires 20 and 21 sweep out a cone at the vertex 22 of which the motor 23 is situated and the axis 24 of the cone is perpendicular to a plane 25 equivalent to frame 3 already described.

Internal illumination means of the body 1' could be provided in a similar manner to that of the first embodiment by providing insulating sections of the wires 20 and 21.

The use of the terms "wires" and "frames" in the above descriptions could be interchanged and the required physical spatial arrangements could of course be made by means of plastic or metal mouldings, wires, or other fabrications as may be convenient as long as the required insulating or conducting properties, as appropriate, were preserved.

Figure 4:
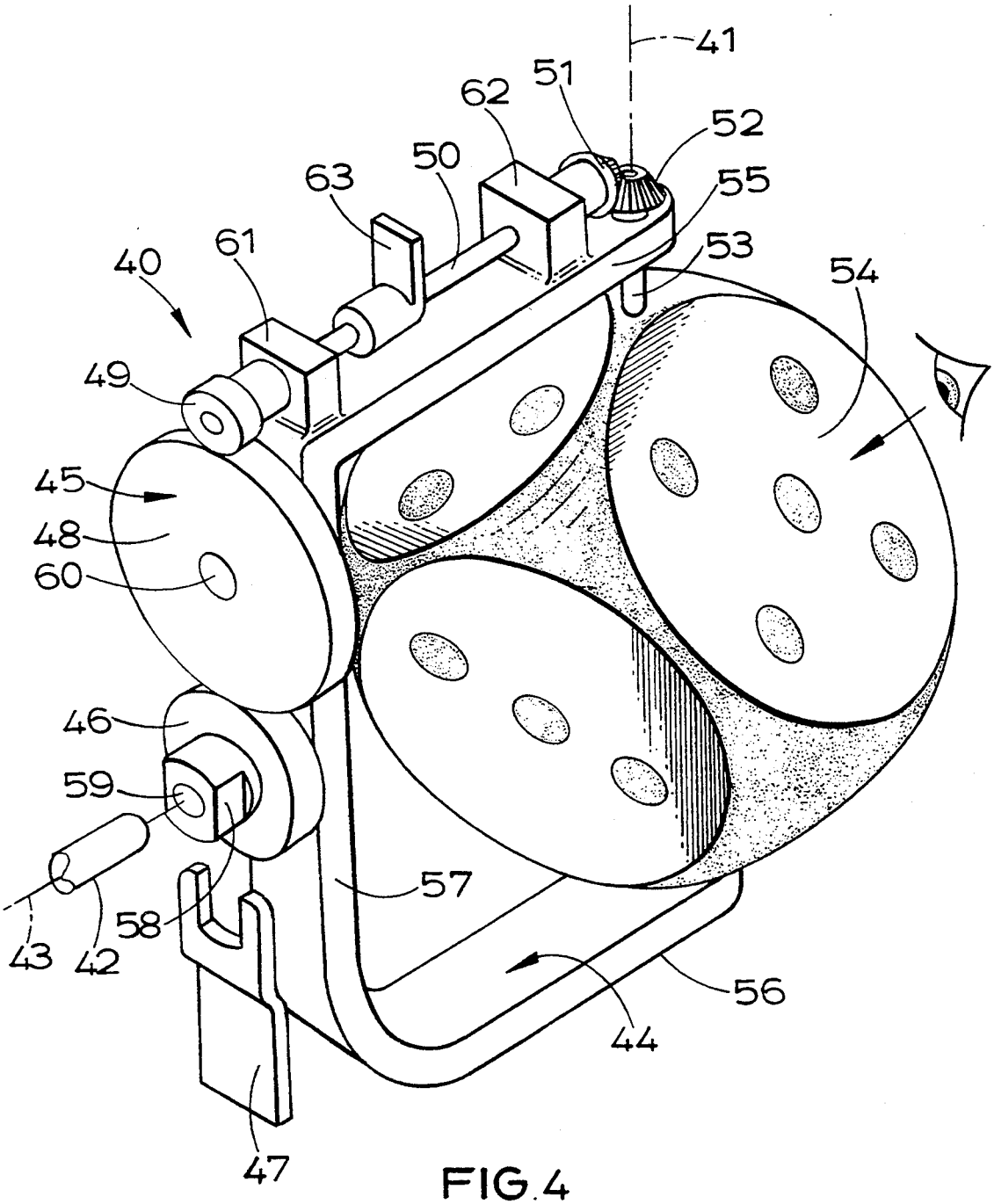
FIG. 4 shows another die mechanism.

FIG. 4 illustrates another arrangement of a die display system 40 in which there is only one drive motor (not shown) and the drive for a first axis of rotation, axis 41, is mechanically linked to the drive shaft 42 of a second axis of rotation, axis 43. Only one motor (not shown) is used, and this drives the shaft 42.

The shaft 42 is connected to a yoke 44, or other die-carrying means which rotates with the shaft 42. An epicyclic gear train 45 is provided and comprises a sun gear 46 which is keyed in a fixed position relative to a support and keying bracket 47, an idler, or intermediate, gear 48 rotatably mounted on the yoke 44, a planetary gear 49 rotatably mounted on the yoke 44 and driving a motive force transfer shaft 50 which has a bevel drive gear 51 co-operating with another bevel drive gear 52 which is fixed to a shaft 53 on which is mounted a die 54 and which defines the first axis 41.

The yoke 44 has an upper arm 55 joined to a lower arm 56 by a mounting limb 57. The sun gear 46 has flats 58 to hold it in fixed relationship relative to the bracket 47, and a central bore 59 through which the shaft 42 extends. The idler gear 45 is rotatably mounted on a stub axle 60 provided on the limb 57.

The motive force transfer shaft 50 is journalled to rotation in two blocks 61 and 62 provided on the arm 55 and carries a sensor paddle 63. An optical sensor (not shown) is provided at a position such that it senses the paddle once for each complete cycle of presentation of the faces of the die to a viewing station.

The rates of rotation of the die about axis 41, and the yoke (and die) about axis 42 are fixed relative to each other and the faces of the die are presented to the viewing station of the fruit machine in turn in a predetermined sequence. Each face of the die, when presented to the viewing station and to a user of the machine, is presented such that the facet is face on to the user and perpendicular to the user's line of sight in viewing the die. It is square-on to the user. In the arrangement of FIG. 4 the gearing ratio between the two axes is 11:3. The die runs through its complete range of face presentations in sequence every three complete revolutions of the directly driven shaft 42. Each successive face of the die is presented in turn to the viewing station every half-turn of the shaft 42. The sensor system is also simplified in that only one sensor is needed and this outputs a signal once every three complete revolutions of the directly driven axis. This provides a reference point which can be interpreted by the control means of the system which controls the die appropriately. Thus the control means can always determine the exact position of the die from the number of motor control impulses fed to a stepper motor controlling the rotation of the shaft 42.

As the shaft 42 is rotated the yoke 44 rotates with it and the idler gear 45 rotates around the sun gear 46. The idler gear drives the planetary gear 49 which drives the shaft 50, which in turn rotates the shaft 53 via the bevelled gears 51 and 52. The sensor paddle 63 executes a compound curve consisting of elements of rotation of the yoke about the main driven axis of rotation 43 and rotation of the paddle about the axis of the shaft 50. The paddle intercepts an optical sensor once every third revolution of the shaft 42.

The arrangement of FIG. 4 has the advantage of needing only a single drive motor, a single sensor, and associated savings in circuitry.

The reels of the fruit machine may have a symbol the appearance of which in the win line, or in the reel display R, enables the player to play a die game with the die display D. Alternatively or additionally the achievement of a feature of a trail or skillshot of the feature display F may entitle the player to play a die game.

Since the user sees the "in play" face square on, and indeed maybe even cannot see, or has difficulty seeing, any other face, the user instinctively knows which face is in play. He does not need any indicating means, such as special illumination, to indicate which of the faces is in play—it is obvious.

The embodiments of the invention in which an exclusive property or privilege is claimed are defined as follows:

1. A machine for playing a game or for amusement comprising:

a viewing station;

a body having a plurality of symbols provided at said viewing station, said body being viewable in use at said viewing station along a sight-line and being supported by axle means, said axle means comprising a single axle passing through said body, said body having a plurality of orientations with respect to said viewing station;

sensor means for detecting the orientation of said body and for producing signals indicative of said symbol presented to said viewing station by said body;

drive means for moving said body between different orientations in which different symbols on said body are presented in turn to said viewing station; and control means for receiving signals from said sensor means and for controlling said drive means so that a chosen symbol presented to said viewing station is known to said control means and is controlled by it, wherein said body is movable about a first axis, and said first axis is movable about a second axis, and wherein said chosen symbol is presented to said viewing station face-on substantially perpendicular to said sight-line.

2. A machine for playing a game or for amusement comprising:

a viewing station;

a body having a plurality of symbols provided at said viewing station, said body being viewable in sue at said viewing station along a sight-line and being supported by axle means, said body having a plurality of orientations with respect to said viewing station;

sensor means for detecting the orientation of said body and for producing signals indicative of said symbol presented to said viewing station by said body;

drive means for moving said body between different orientations in which different symbols on said body are presented in turn to said viewing station; and control means for receiving signals from said sensor means and for controlling said drive means so that a chosen symbol presented to said viewing station is known to said control means and is controlled by it, wherein said body is movable about a first axis, and said first axis is movable about a second axis, wherein said first and second axes are substantially perpendicular, and wherein said chosen symbol is presented to said viewing station face-on, substantially perpendicular to said sight-line.

3. A machine for playing a game or for amusement comprising:

a viewing station;

a body having a plurality of symbols provided at said viewing station, said body being viewable in use at said viewing station along a sight-line and being supported by axle means, said body having a plurality of orientations with respect to said viewing station;

sensor means for detecting the orientation of said body and for producing signals indicative of said symbol presented to said viewing station by said body;

drive means for moving said body between different orientations in which different symbols on said body are presented in turn to said viewing station; and control means for receiving signals form said sensor means and for controlling said drive means so that a chosen symbol presented to said viewing station is known to said control means and is controlled by it, wherein said body is movable about a first axis, and said first axis is movable about a second axis, and wherein said body is supported by a first axle portion coupled to one side of said body and by a second axle or axle portion coupled to another side of said body.

4. A machine for playing a game or for amusement comprising:

a viewing station;

a body having a plurality of symbols provided at said viewing station, said body being viewable in sue at said viewing station along a sight-line and being supported by axle means, said axle means comprising a single axle passing through said body, said body having a plurality of orientations with respect to said viewing station;

drive means for moving said body between different orientations in which different symbols on said body are presented to said viewing station; and control means for controlling said drive means, wherein said body is movable about a first axis, and said first axis is movable about a second axis, and wherein at least one of said symbols on said body is presentable to said viewing station face-on, substantially perpendicular to said sight-line.

5. A machine for playing a game or for amusement comprising:

a viewing station;

a body having a plurality of symbols provided at said viewing station, said body being viewable in use at said viewing station along a sight-line and being supported by axle means, said body having a plurality of orientations with respect to said viewing station;

drive means for moving said body between different orientations in which different symbols on said body are presented to said viewing station; and control means for controlling said drive means, wherein said body is movable about a first axis, and said first axis is movable about a second axis, wherein said first and second axes are substantially perpendicular, and wherein at least one of said symbols on said body is presentable to said viewing station face-on, substantially perpendicular to said sight-line.

6. A machine for playing a game or for amusement comprising:

a viewing station;

a body having a plurality of symbols provided at said viewing station, said body being viewable in sue at said viewing station along a sight-line and being supported by axle means, said body having a plurality of orientations with respect to said viewing station;

at least one rotatable reel having further symbols presented at its periphery, said further symbols being viewable in use by the user;

drive means for moving said body between different orientations in which different symbols on said body are presented to said viewing station; and control means for controlling said drive means, wherein said body is movable about a first axis, and said first axis is movable about a second axis, and wherein at least one of said symbols on said body is presentable to said viewing station face-on, substantially perpendicular to said sight-line.

7. A machine for playing a game or for amusement comprising:

a viewing station;

a body having a plurality of symbols provided at said viewing station, said body being viewable in use at said viewing station along a sight-line and being supported by axle means, said body having a plurality of orientations with respect to said viewing station;

drive means for moving said body between different orientations in which different symbols on said body are presented to said viewing station; and control means for controlling said drive means, wherein said body is movable about a first axis, and said first axis is movable about a second axis and wherein said body is supported by a first axle portion coupled to one side of said body and by a second axle or axle portion coupled to the other side of said body.

8. A machine in accordance with claim 7, wherein said body is internally illuminated.

9. A machine in accordance with claim 7, wherein said body is carried by yoke means.

10. A machine in accordance with claim 7, wherein in addition to said body there is provided at least one reel having further symbols presented at its periphery, said further symbols being viewable in use by the user.

11. A machine in accordance with claim 7, wherein said axle means comprises a single axle passing through said body.

12. A machine in accordance with claim 7, wherein said body is substantially cubic and said axle means passes through opposed vertices of said body.

13. A machine for playing a game or for amusement comprising:

a viewing station;

a body having a plurality of symbols provided at said viewing station, said body being viewable in use at said viewing station along a sight-line and being supported by axle means, said body having a plurality of orientations with respect to said viewing station;

drive means adapted to move said body between different orientations in which different symbols of said body are presented to said viewing station; and control means adapted to control said drive means, and wherein said body is movable about a first axis and said first axis is movable about a second axis, and said first and second axes are substantially perpendicular.

14. A mechanism adapted for incorporation in a machine for playing a game or for amusement, said mechanism comprising:

a viewing station;

a body having a plurality of symbols provided at said viewing station, said body being viewable in use at said viewing station along a sight-line and wherein said body is supported by a first axle portion coupled to one side of said body and by a second axle or axle portion coupled to another side of said body, said body having a plurality of orientations with respect to said viewing station;

drive means adapted to move said body between different orientations in which different symbols of said body are presented to said viewing station; and control means adapted to control said drive means, wherein said body is movable about a first axis and said first axis is movable about a second axis, and wherein at least one of said symbols is presentable to said viewing station face-on, substantially perpendicular to said sight-line.

15. A mechanism adapted for incorporation in a machine for playing a game or for amusement, said mechanism comprising:

a viewing station;

a body having a plurality of symbols provided at said viewing station, said body being viewable in use at said viewing station along a sight-line and being supported by axle means, said body having a plurality of orientations with respect to said viewing station;

drive means adapted to move said body between different orientations in which different symbols of said body are presented to said viewing station; and control means adapted to control said drive means, wherein said body is movable about a first axis and said first axis is movable about a second axis, wherein said first and second axes are substantially perpendicular and wherein at least one of said symbols is presentable to said viewing station face-on, substantially perpendicular to said sight-line.

* * * * *

UNITED STATES PATENT AND TRADEMARK OFFICE

CERTIFICATE OF CORRECTION

PATENT NO. : 5,344,145

DATED : September 6, 1994

INVENTOR(S) : N.D. Chadwick et al.

It is certified that error appears in the above-indentified patent and that said Letters Patent is hereby corrected as shown below:

| COLUMN | LINE | |
|---|---|---|
| 3 | 16 | "EMBODIMENTS" should read --EMBODIMENT-- |
| 6 (Claim 2, | 18 Line 5) | "sue" should read --use-- |
| 7 (Claim 4, | 5 Line 5) | "sue" should read --use-- |
| 7 (Claim 6, | 44 Line 5) | "sue" should read --use-- |

Signed and Sealed this

Third Day of January, 1995

Bruce Lehman

*Attest:*

BRUCE LEHMAN

*Attesting Officer*

*Commissioner of Patents and Trademarks*